US009890939B2

(12) United States Patent
Feng et al.

(10) Patent No.: US 9,890,939 B2
(45) Date of Patent: Feb. 13, 2018

(54) SWITCH STRUCTURE AND FLASHLIGHT WITH THE SAME

(71) Applicant: Nextorch Industries Co., Ltd., Guangdong (CN)

(72) Inventors: Zhibin Feng, Guangdong (CN); Guoxin Yu, Guangdong (CN); Bing Liang, Guangdong (CN)

(73) Assignee: NEXTORCH INDUSTRIES CO., LTD., Guangdong (CN)

( * ) Notice: Subject to any disclaimer, the term of this patent is extended or adjusted under 35 U.S.C. 154(b) by 53 days.

(21) Appl. No.: 15/156,918

(22) Filed: May 17, 2016

(65) Prior Publication Data

US 2016/0348882 A1 Dec. 1, 2016

(30) Foreign Application Priority Data

May 25, 2015 (CN) ..... 2015 2 0344064 U

(51) Int. Cl.

| | |
|---|---|
| ***F21L 4/00*** | (2006.01) |
| ***F21V 23/04*** | (2006.01) |
| ***H01H 9/02*** | (2006.01) |
| ***H01H 13/14*** | (2006.01) |

(52) U.S. Cl.

CPC ..... *F21V 23/0421* (2013.01); *F21L 4/00* (2013.01); *H01H 9/0214* (2013.01); *H01H 9/0271* (2013.01); *H01H 13/14* (2013.01)

(58) Field of Classification Search

CPC ..... F21L 4/00; H01H 9/0214; H01H 9/0271; H01H 13/14; F21V 23/04; F21V 23/0421; F21V 23/0428; F21V 23/0414

See application file for complete search history.

(56) References Cited

U.S. PATENT DOCUMENTS

2005/0077837 A1* 4/2005 Kim ..... F21L 4/025 315/200 A

2013/0049582 A1* 2/2013 West ..... H05B 33/0824 315/33

* cited by examiner

*Primary Examiner* — Laura Gudorf

(74) *Attorney, Agent, or Firm* — Porter Wright Morris & Arthur LLP

(57) ABSTRACT

The invention provides a switch structure and a flashlight with the same. The switch structure includes: a switch housing; a control part, the control part being provided in the switch housing; and a moving part, the moving part being provided movably in the switch housing, the moving part has a first stroke where the control part is enabled to output a first control signal and a second stroke where the control part is enabled to output a second control signal and the second stroke being consisted of the first stroke and a subsequent stroke after the first stroke. The switch structure may conveniently switch different illumination modes.

18 Claims, 11 Drawing Sheets

SWITCH STRUCTURE AND FLASHLIGHT WITH THE SAME

TECHNICAL FIELD OF THE INVENTION

The invention relates to a field of illumination equipment, and in particular to a switch structure and a flashlight with the same.

BACKGROUND OF THE INVENTION

Nowadays, use of flashlights in the field of tactics is increasingly emphasized. During confrontation of two armies in the darkness, directly irradiating eyes of enemies with light beams to disable the enemies to identify own accurate positions may effectively increase a probability of winning in this confrontation. When breaking into rooms for assaulting, soldiers and police can use constant beam or strobe irradiation to get the other party in control. In such an emergency, a tactical flashlight which may be simply operated with one hand and may enter a momentary activation (constant beam) or strobe mode is required. For realizing such a function, a reliable mechanical switch capable of enable the flashlight to enter the strobe mode or the momentary activation mode with a key is required.

SUMMARY OF THE INVENTION

A main purpose of the invention is to provide a switch structure and a flashlight with the same, so as to solve the problem that a flashlight in a conventional art may not be conveniently switched into different illumination modes.

In order to achieve the purpose, according to one aspect of the invention, a switch structure is provided, which comprises: a switch housing; a control part, the control part being provided in the switch housing; and a moving part, the moving part being movably provided in the switch housing, the moving part having a first stroke where the control part is enabled to output a first control signal and a second stroke where the control part is enabled to output a second control signal and the second stroke being consisted of the first stroke and a subsequent stroke after the first stroke.

Furthermore, the control part comprises a control circuit, and when the moving part moves by the first stroke, the control circuit of the control part is switched on through the moving part, and outputs the first control signal; and when the moving part moves to the second stroke within a preset time, the control circuit of the control part undergoes a preset switching on and switching off process through the moving part, and outputs the second control signal.

Furthermore, the preset switching on and switching off process is a process of switching on to witching off to switching on.

Furthermore, the control part comprises a circuit board and an electrical conductor which is provided on the circuit board and connected with the control circuit on the circuit board, and the moving part comprises: a conductive switch column, the conductive switch column being provided movably in the switch housing and a first end of the conductive switch column having a conductive head; and an insulating ring, the insulating ring being fixedly provided on the conductive switch column and located behind the conductive head, the conductive head contacting with the electrical conductor and enabling the control circuit to output the first control signal when the moving part moves by the first stroke, and the conductive head, the insulating ring and the conductive switch column sequentially contacting with the electrical conductor and enabling the control circuit to output the second control signal when the moving part moves by the second stroke.

Furthermore, a mounting hole is provided in the first end of the conductive switch column, the conductive head is a conductive screw, the conductive screw is mounted in the mounting hole, and the insulating ring is provided on the conductive screw in a sleeving manner, and is located between a cap of the conductive screw and the conductive switch column.

Furthermore, the circuit board is provided with a through hole through which the moving part passes, and a part of the electrical conductor is raised from a peripheral wall of the through hole.

Furthermore, the electrical conductor comprises conductive spring wires or current pins or conductive sheets.

Furthermore, the control part comprises a circuit board and an elastic piece which is provided on the circuit board and connected with the control circuit of the circuit board, the elastic piece is provided with a fixed end connected with the control circuit, a normally closed contact connected with the control circuit and a normally open contact separated from the control circuit in a free state, the normally closed contact and the normally open contact are located on two sides of the circuit board respectively, and are both connected with the fixed end, and the moving part comprises: a conductive switch column, the conductive switch column being provided movably in the switch housing, the conductive switch column contacting with the normally open contact and enabling the control part to output the first control signal when the conductive switch column moves by the first stroke; when the conductive switch column moves by the second stroke, the elastic piece has a first state, a second state and a third state; in the first state, the normally open contact contacts with the conductive switch column and the normally closed contact contacts with the control circuit; in the second state, the normally open contact is driven by the conductive switch column to get close to the control circuit and does not contact with the control circuit, and the normally closed contact is driven to be separated from the control circuit; and in the third state, the normally open contact contacts with the control circuit and the normally closed contact is separated from the control circuit.

Furthermore, the switch structure further comprises an elastic returning part, and the elastic returning part is provided between the moving part and the switch housing, and drives the moving part to return to an initial position.

According to the other aspect of the invention, a flashlight is provided, which comprises a light source and a switch structure, wherein the switch structure is the abovementioned switch structure, the light source at least has a first state of continuous irradiation and a second state of switching on and switching off according to a preset frequency, the switch structure is electrically connected with the light source, the light source is in the first state when the switch structure outputs a first control signal, and the light source is in the second state when the switch structure outputs a second control signal.

According to the technical solutions of the invention, the switch structure comprises: the switch housing; the control part, the control part being provided in the switch housing; and the moving part, the moving part being provided movably in the switch housing, the moving part having the first stroke where the control part is enabled to output the first control signal and the second stroke where the control part is enabled to output the second control signal and the second stroke being consisted of the first stroke and the subsequent stroke after the first stroke. The switch structure may switch modes conveniently and simply, and is used conveniently and rapidly.

BRIEF DESCRIPTION OF THE DRAWINGS

Specification drawings forming a part of the invention are adopted to provide further understanding of the invention, and schematic embodiments of the invention and description thereof are adopted to explain the invention and not intended to form improper limits to the invention. In the drawings.

Figure 1:
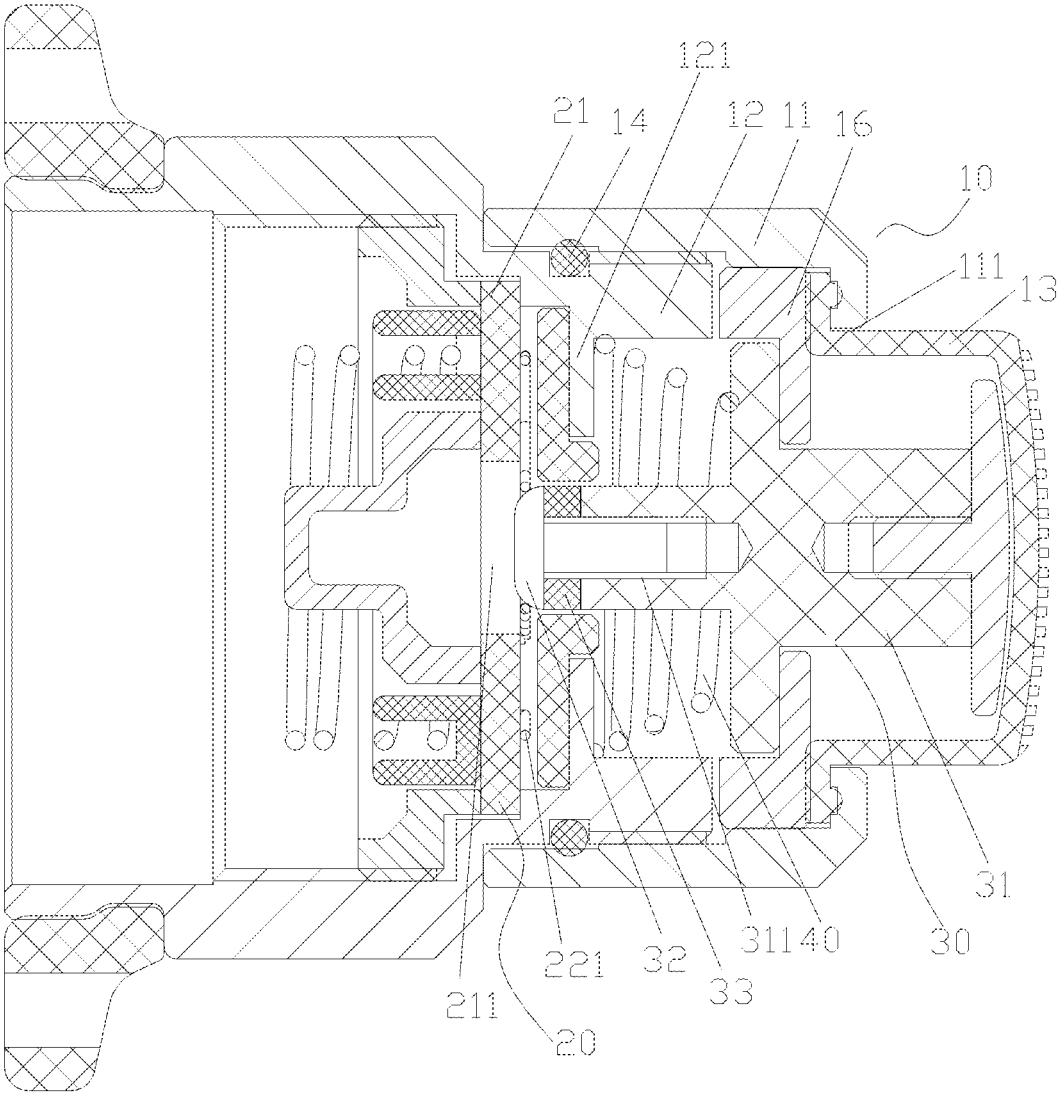
FIG. 1 is a section view of a switch structure according to a first embodiment of the invention.

Wherein, the drawings include the following drawing reference signs:

10: switch housing; 11: main cover; 111: button hole; 12: mounting table; 121: bearing table; 13: rubber cap; 14: sealing ring; 16: fixed ring; 20: control part; 21: circuit board; 211: through hole; 221: conductive spring wire; 222: current pin; 23: elastic piece; 231: fixed end; 232: normally closed contact; 233: normally open contact; 30: moving part; 31: conductive switch column; 311: mounting hole; 32: conductive head; 33: insulating ring; 40: elastic returning part; 70: light source; 80: power supply; 91: first signal; and 92: second signal.

DETAILED DESCRIPTION OF THE EMBODIMENTS

It is important to note that embodiments in the invention and characteristics in the embodiments can be combined under the condition of no conflicts. The invention will be described below with reference to the drawings and the embodiments in detail.

As shown in FIG. 1 to FIG. 8, according to an embodiment of the invention, a confrontation flashlight is usually at least required to have a momentary activation mode and a strobe mode to meet a using requirement. Wherein, the momentary activation mode refers to that a light source 70 is kept in an on state for continuous illumination. The strobe mode refers to that the light source 70 is switched between the on state and an off state at a certain frequency. Such a switching frequency may be set according to different requirements, and the switching frequency of the strobe mode of the flashlight in the invention is 9 Hz to 12 Hz (in other embodiments, the switching frequency may not be within this range, and may be set freely). Of course, the flashlight may be configured for confrontation, and is also applied to daily life or other environments with such a requirement.

It is important to note that the flashlight may also have other illumination modes, and for example, a strobe mode adopting multiple different switching frequencies may be set.

In a first embodiment, a flashlight at least comprises a housing, a light source 70, a power supply 80 and a switch structure.

The housing is used for bearing the other parts.

The light source 70 is provided on the housing, and at least has a first state of continuous irradiation and a second state of switching on and switching off according to a preset frequency. The first state is the momentary activation mode, and the second state is the strobe mode.

The power supply 80 is provided in the housing, and is connected with the light source 70 through the switch structure.

The switch structure is electrically connected with the light source 70, and the switch structure controls current input to the light source 70, so that to control the light source 70 to irradiate according to a required mode. In the embodiment, the switch structure may output a first control signal and a second control signal. When the first control signal is output, the light source 70 is in the first state, and when the switch structure outputs a second control signal, the light source 70 is in the second state.

Figure 11:
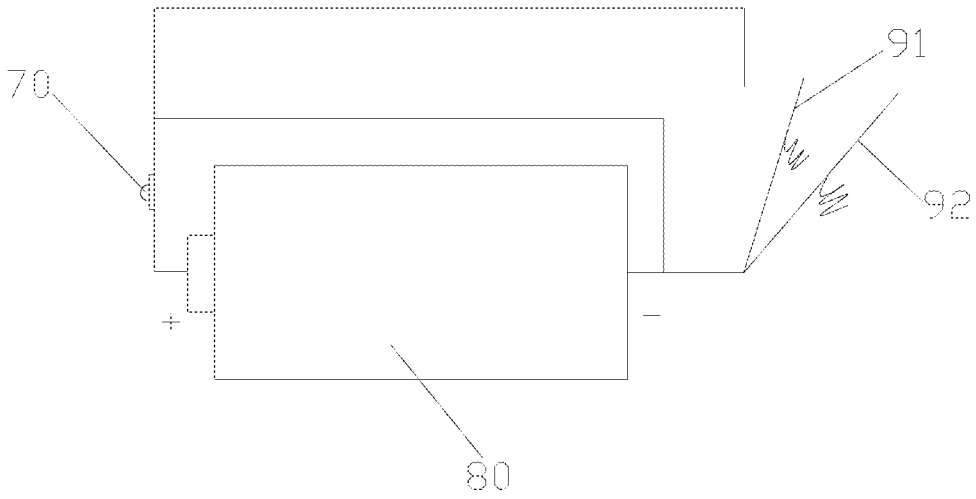
FIG. 11 is a schematic diagram of an embodiment of the invention.

Referring to FIG. 11, in the embodiment, a principle of the flashlight is that the power supply 80 is connected with the light source 70 through the switch structure, and the flashlight enters the momentary activation mode when being switched on through a first signal 91, and enters the strobe mode when being switched on through a second signal 92.

Figure 2:
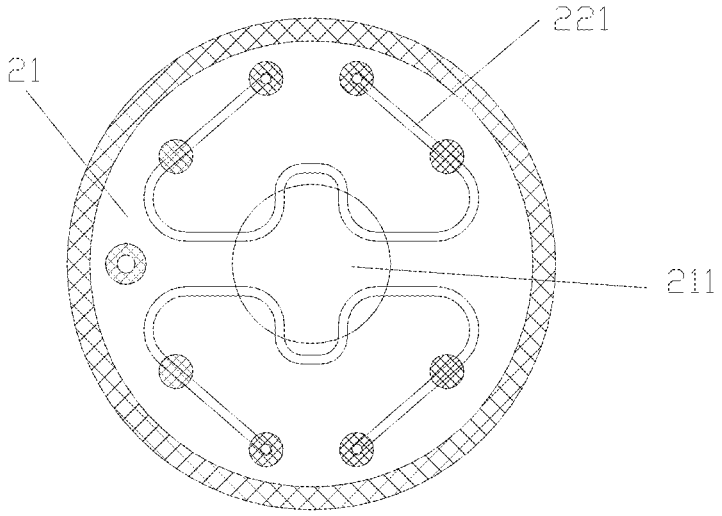
FIG. 2 is a structure diagram of a control part of a switch structure according to a first embodiment of the invention.

Specifically, referring to FIGS. 1 and 2, in the embodiment, the switch structure comprises a switch housing 10, a control part 20 and a moving part 30.

Wherein, the switch housing 10 is used for connection with the housing of the flashlight, and is also used for bearing the other parts of the switch structure. The switch housing comprises a main cover 11 matched with the housing of the flashlight, a mounting table 12 provided in the main cover 11, a rubber cap 13 which is provided in a button hole 111 of the main cover 11 and extends from the button hole 111, and the like. The rubber cap 13 is fixed on the main cover 11 through a fixed ring 16.

Referring to FIG. 1, an inner cavity of the main cover 11 is in threaded connection with the mounting table 12, and the mounting table 12 and the housing of the flashlight form an integrated structure. A sealing ring 14 is provided between the mounting table 12 and the main cover 11. The mounting table 12 is provided with a bearing table 121 which is inwards raised.

It is important to note that the mounting table 12 and the housing of the flashlight may form the integrated structure, and may also be split structures which are independently machined.

The control part 20 is provided in the switch housing 10, and is used for outputting the control signals according to a position of the moving part 30. The control part 20 comprises a circuit board 21 and an electrical conductor which is provided on the circuit board 21 and connected with a control circuit on the circuit board 21.

The circuit board 21 is provided on the side, far away from the button hole 111, of the bearing table 121. The circuit board 21 is provided with a through hole 211 through which the moving part 30 passes, and a part of the electrical conductor is raised from a peripheral wall of the through hole 211 to form good and reliable contact with the moving part 30. The control circuit comprises a single-chip microcomputer or another programmable control chip and other elements.

The moving part 30 is provided movably in the switch housing 10, a user may press the moving part 30 to drive the moving part 30 to move, and the moving part 30 may move by different strokes to control the light source 70 of the flashlight to implement different irradiation modes.

The moving part 30 comprises a conductive switch column 31 and an insulating ring 33.

A first end of the conductive switch column 31 is provided with a conductive head 32 contacting with the control part 20, a second end of the conductive switch column 31 extends from the button hole 111, and the rubber cap 13 covers the second end of the conductive switch column 31. The conductive switch column 31 is provided with a limiting flange, the limiting flange is matched with the fixed ring 16 to limit a position of the conductive switch column 31, and when the limiting flange of the conductive switch column 31 contacts with the fixed ring 16, the conductive switch column 31 is at an initial position.

The insulating ring 33 is fixedly provided on the conductive switch column 31, and is located behind the conductive head 32.

In the embodiment, a mounting hole 311 is provided in the first end of the conductive switch column 31, the conductive head 32 is a conductive screw, the conductive screw is mounted in the mounting hole 311, and the insulating ring 33 is provided on the conductive screw in a sleeving manner, and is located between a cap of the conductive screw and the conductive switch column 31.

When working, the moving part 30 has a first stroke where the moving part 30 contacts with the control part 20 and the control part 20 is enabled to output the first control signal and a second stroke where the moving part 30 contacts with the control part 20 and the control part 20 is enabled to output the second control signal, the second stroke is consisted of the first stroke and a subsequent stroke after the first stroke, that is, the moving part 30 moves from the initial position to a position where it is connected with the control part 20 for the first time to form the first stroke. In such a manner, the moving part 30 may be move by different strokes according to different illumination requirements to control the flashlight to implement the required illumination mode with a key, and simplicity, high speed and reliability in operation are achieved.

When the moving part 30 moves by the first stroke, the control circuit of the control part 20 is switched on through the moving part 30, and outputs the first control signal; and when the moving part 30 moves by the second stroke within a preset time, the control circuit of the control part 20 undergoes a preset switching on and switching off process through the moving part 30, and outputs the second control signal.

In the embodiment, the preset switching on and switching off process is a process of switching on to switching off to switching on. In the other embodiments, another preset switching on and switching off process may be set according to a requirement, and for distinction from the momentary activation mode, a preset switching on and switching off process in the strobe mode preferably comprises an odd number of nodes, for example, the preset switching on and switching off process is set to be a process of switching on to switching off to switching on to switching off to switching on. If such a preset switching on and switching off process is adopted, it is necessary to additionally arrange the insulating ring 33 on the conductive switch column 31, and correspondingly, when such a preset switching on and switching off process is adopted, a stroke of the conductive switch column 31 is longer.

Specifically, when the flashlight is required to enter the momentary activation mode, the moving part 30 moves by the first stroke, the conductive head 32 contacts with the electrical conductor and enables the control circuit to output the first control signal, the light source 70 of the flashlight is in the first state, the light source 70 is in the momentary activation mode, the light source 70 is kept to be pressed for continuous illumination, and the light source 70 is released to be switched off.

When the flashlight is required to enter the strobe mode, the rubber cap 13 is pressed to drive the conductive switch column 31 to move, the moving part 30 moves by the second stroke, that is, the conductive head 32, the insulating ring 33 and the conductive switch column 31 sequentially contact with the electrical conductor, and when the conductive head 32 contacts with the electrical conductor, the control circuit on the circuit board 21 is switched on, the single-chip microcomputer receives a switching-on signal, then the insulating ring 33 contacts with the electrical conductor, the control circuit is switched off because the insulating ring 33 is insulating, the single-chip microcomputer receives a switching-off signal, the conductive switch column 31 continues moving, and contacts with the electrical conductor, the control circuit is switched on again, the single-chip microcomputer receives a switching-on signal, and determines that the switching on and switching off process is consistent with the preset switching on and switching off process and is implemented within a preset time, then the control circuit outputs the second control signal, and the light source 70 enters the strobe mode. The flashlight adopting the switch structure may enter the strobe mode with one key by pressing the moving part 30, so that high speed and convenience in use and high reliability are ensured.

The flashlight is controlled to enter the strobe mode with one key through the switch structure, so that simplicity in operation, high reliability and favorability for confrontation are ensured.

In the embodiment, in order to facilitate use, the switch structure further comprises an elastic returning part 40, and the elastic returning part 40 is provided between the bearing table 121 and the limiting flange of the conductive switch column 31, and is used for automatically rebounding the conductive switch column 31 to the initial position. In the embodiment, the elastic returning part 40 is a spring, and in the other embodiments, the elastic returning part 40 may also be other structures.

In the embodiment, in order to facilitate use, the switch structure is located at a tail end of the flashlight for the user to conveniently press, so that the aim of conveniently and rapidly controlling the irradiation mode of the flashlight is fulfilled.

Referring to FIG. 2, in the embodiment, the electrical conductor comprises two conductive spring wires 221. The conductive spring wires 221 are bent into four contacts, and the four contacts are raised from the peripheral wall of the through hole 211 to form good and reliable contact with the conductive head 32 of the conductive switch column 31.

In the other embodiments, the number and shape of the conductive spring wires 221 may be determined according to different requirements. It is important to note that the conductive spring wires 221 may be wires made from any conductive material as long as the conductive head 32 may be ensured to pass through the conductive spring wires 221 and may be conductive when contacting with the conductive spring wires 221. The conductive spring wires 221 may be copper wires.

Referring to FIGS. 3 to 6, according to a second embodiment of the invention, in the embodiment, an elastic piece 23 is provided on the circuit board 21, the conductive head 32 and the insulating ring 33 are not provided on the conductive switch column 32, and structures of the other parts are the same as those in the first embodiment.

Figure 3:
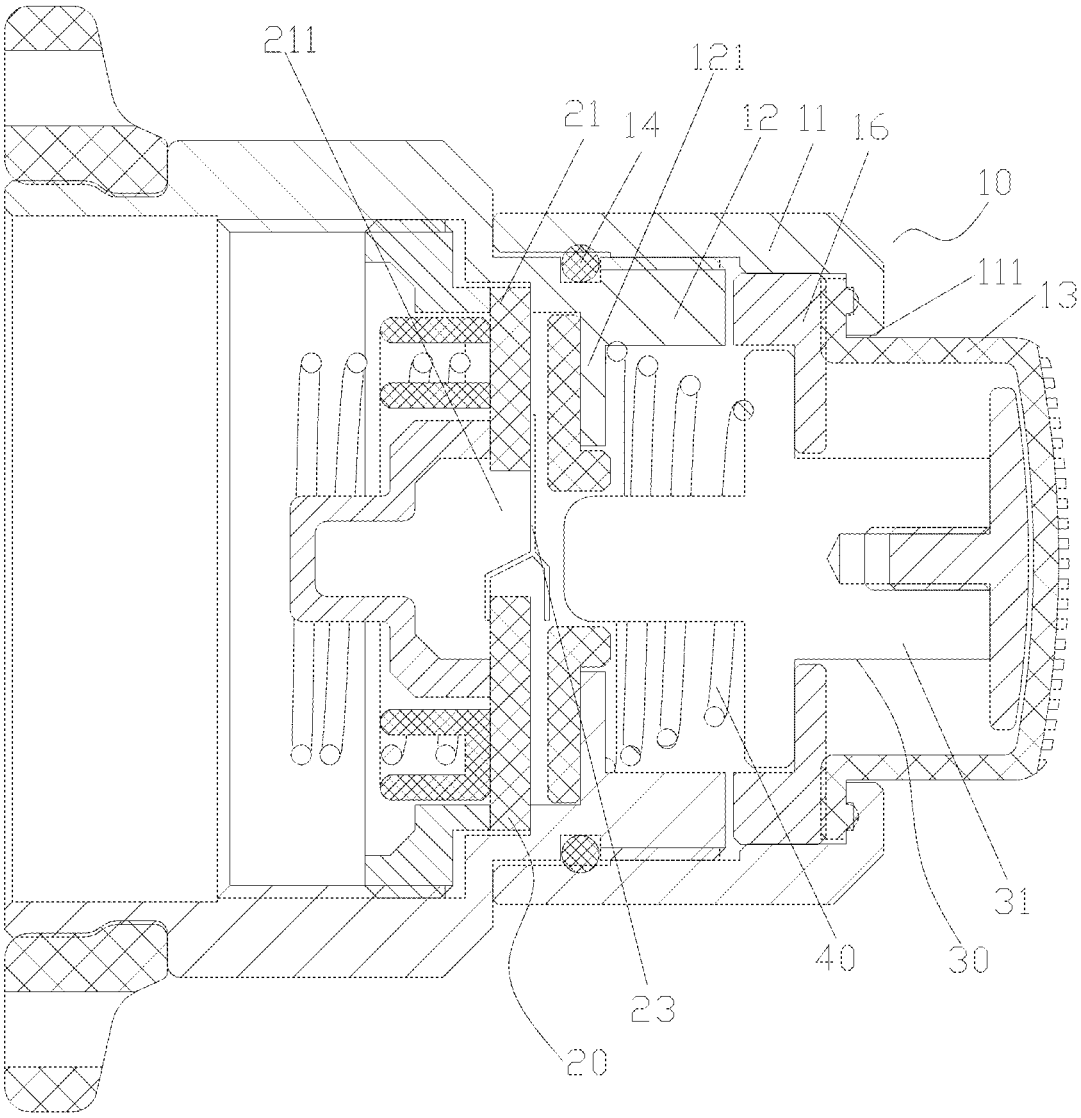
FIG. 3 is a section view of a switch structure according to a second embodiment of the invention.
Figure 4:
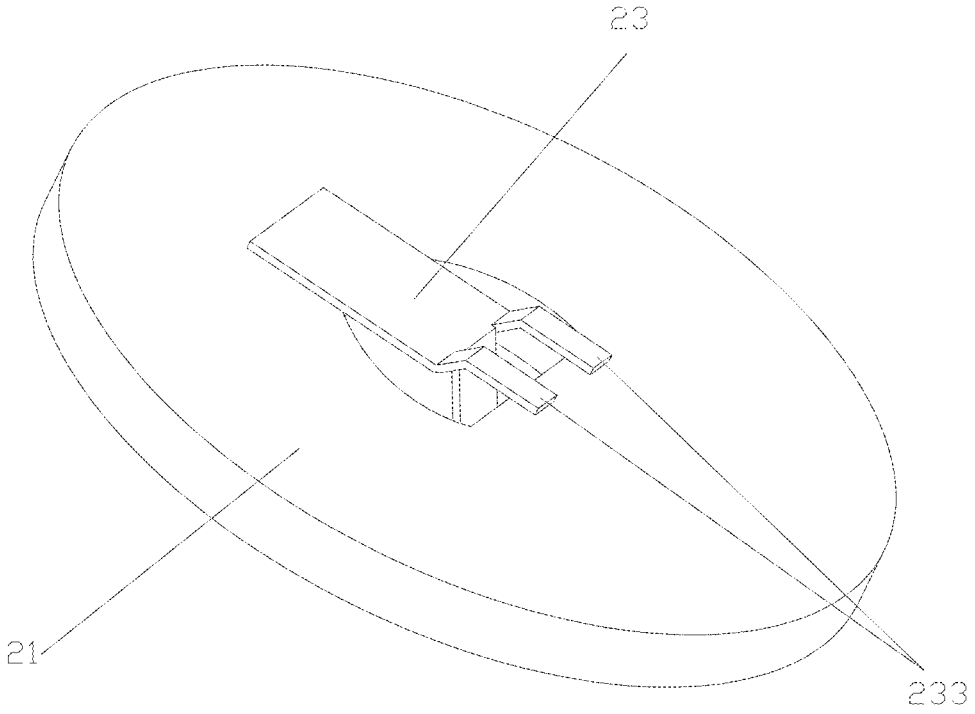
FIG. 4 is a three-dimensional structure diagram of a control part of a switch structure according to a second embodiment of the invention.
Figure 5:
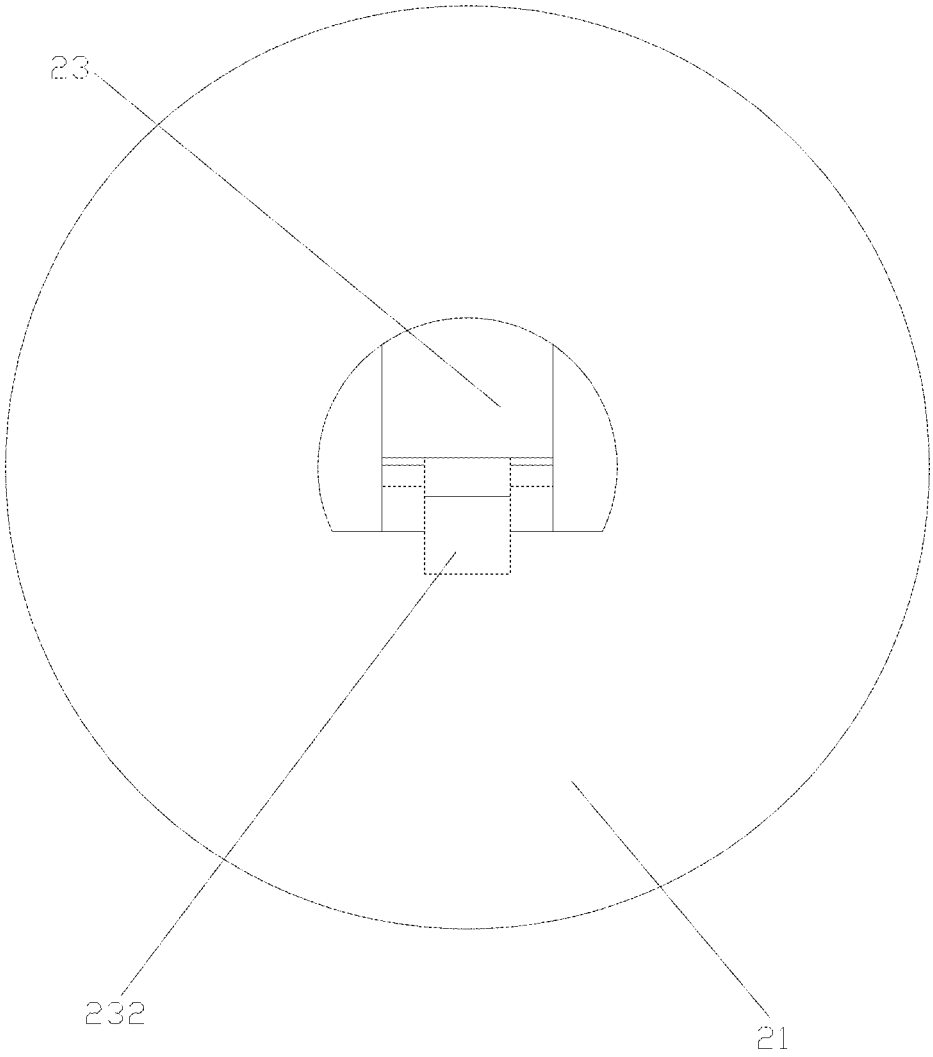
FIG. 5 is a back view of a control part of a switch structure according to a second embodiment of the invention.
Figure 6:
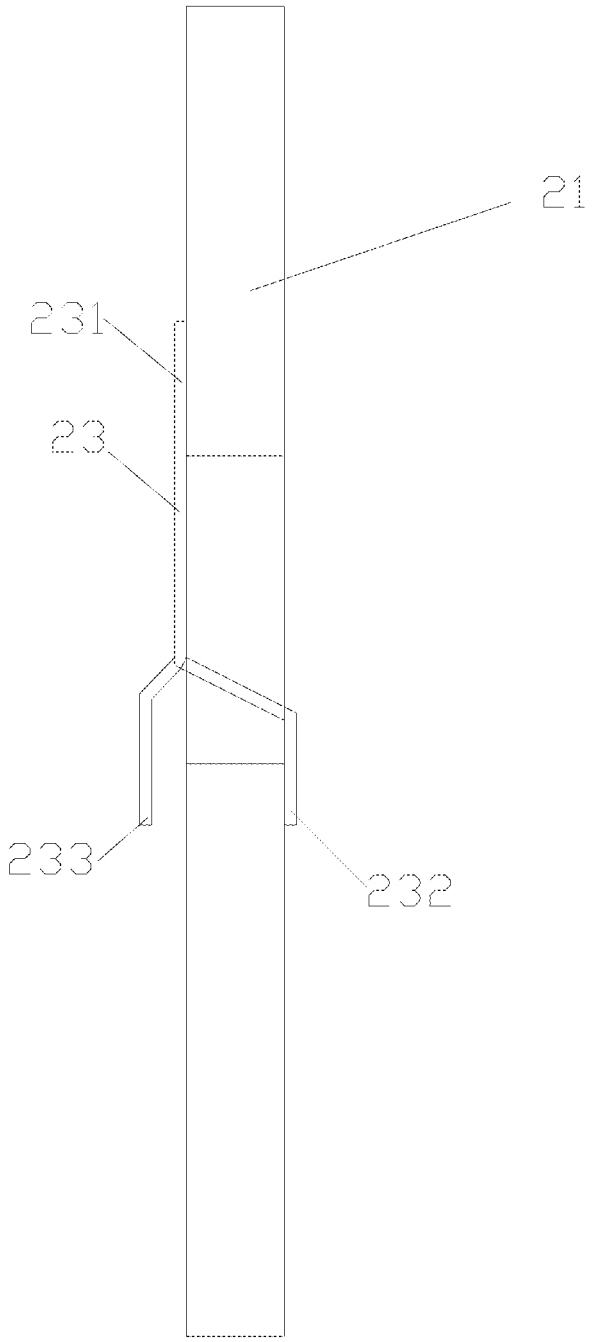
FIG. 6 is a side view of a control part of a switch structure according to a second embodiment of the invention.
Figure 7:
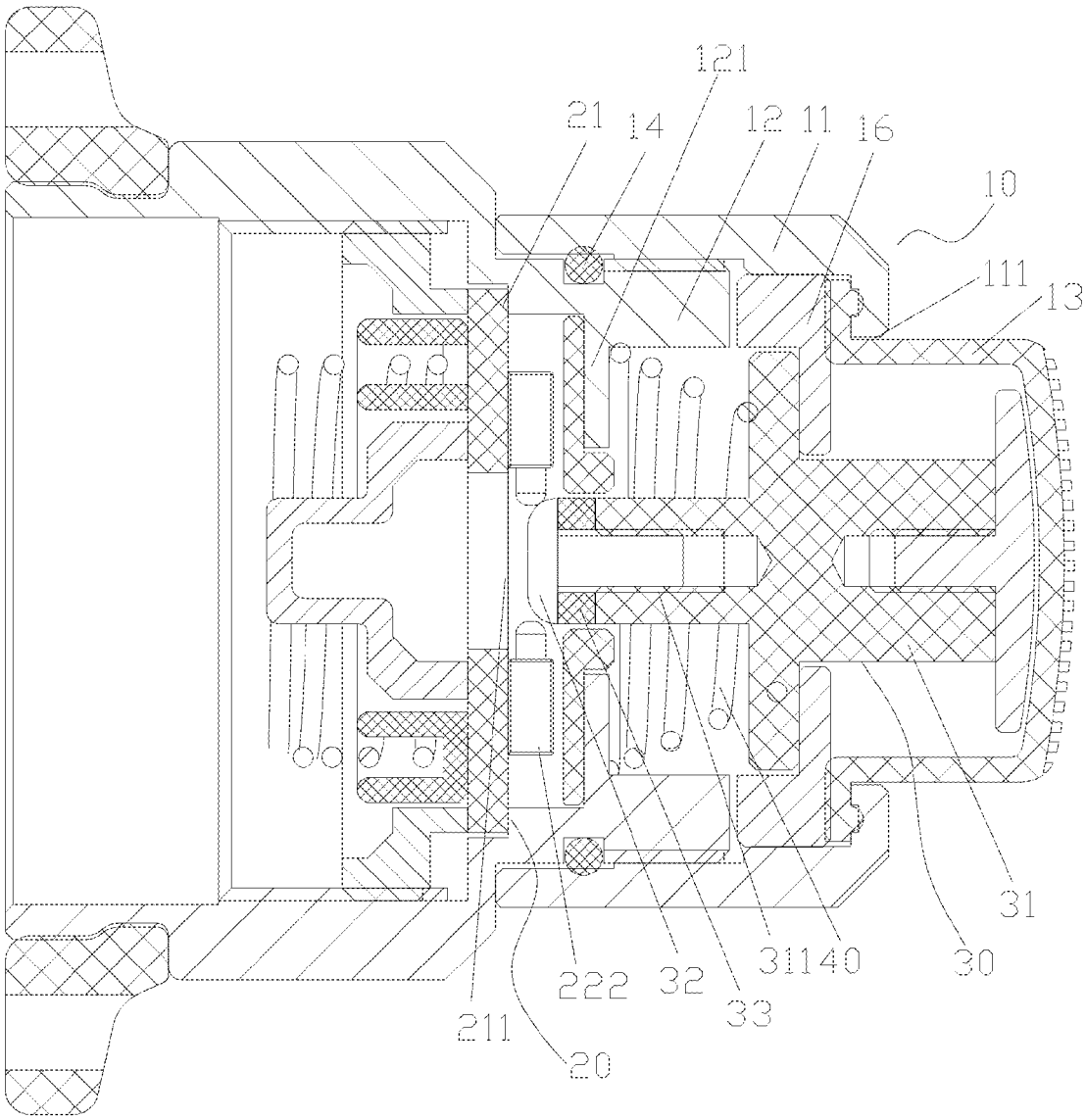
FIG. 7 is a section view of a switch structure according to a third embodiment of the invention.
Figure 8:
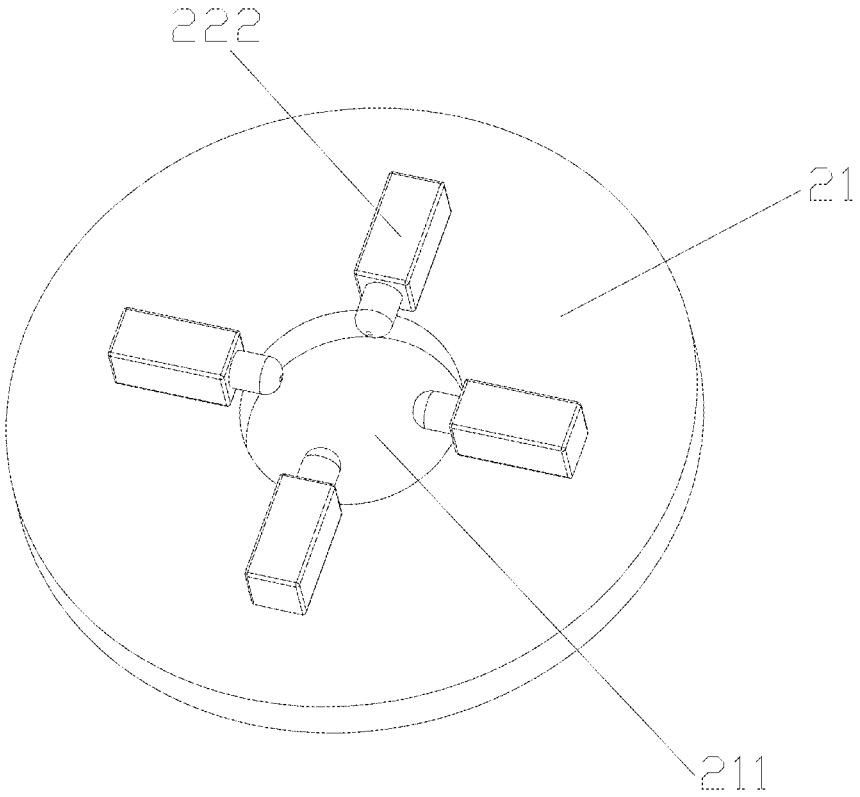
FIG. 8 is a three-dimensional structure diagram of a control part of a switch structure according to a third embodiment of the invention.
Figure 9:
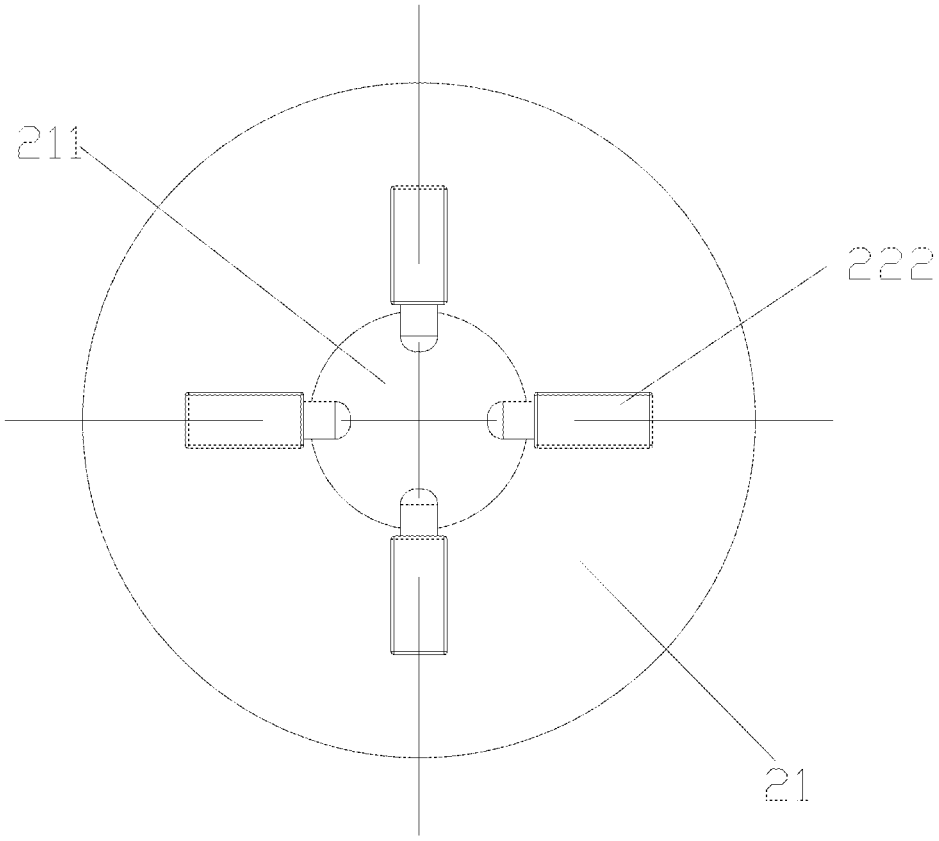
FIG. 9 is a top view of a control part of a switch structure according to a third embodiment of the invention.
Figure 10:
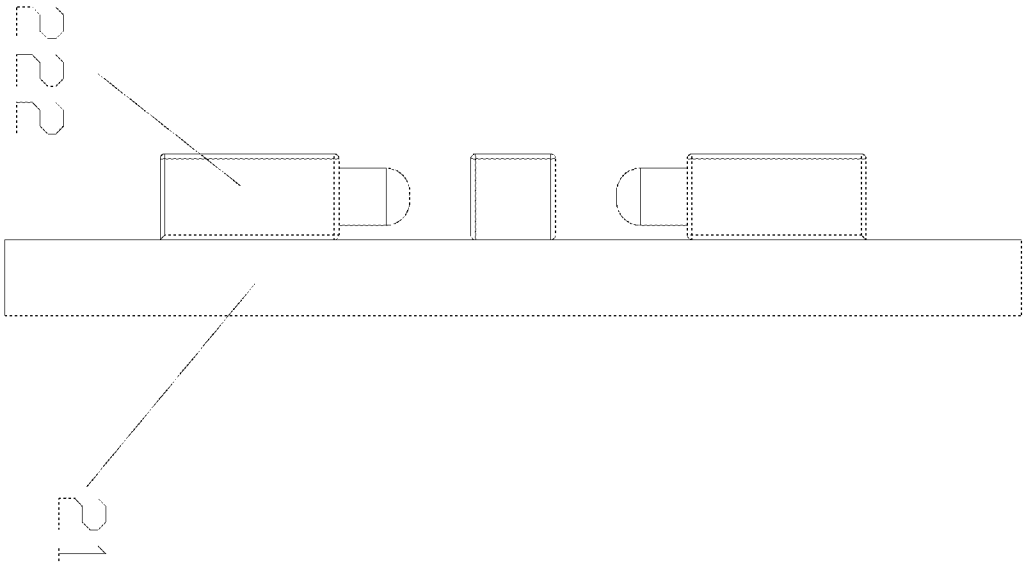
FIG. 10 is a side view of a switch structure according to a third embodiment of the invention.

As shown in FIG. 3, the control part 20 comprises the circuit board 21 and the elastic piece 23 which is provided on the circuit board 21 and connected with the control circuit of the circuit board 21.

The elastic piece 23 is provided with a fixed end 231 connected with the control circuit, a normally closed contact 232 connected with the control circuit and a normally open contact 233 separated from the control circuit in a free state, and the normally closed contact 232 and the normally open contact 233 are located on two sides of the circuit board 21 respectively, and are both connected with the fixed end 231.

The conductive switch column 31 of the moving part 30 is movably provided in the switch housing 10, and when the conductive switch column 31 moves by the first stroke, the conductive switch column 31 contacts with the normally open contact 233, the control circuit is switched on through the conductive switch column 31, the normally open contact 233 and the fixed end 231, the single-chip microcomputer receives a switching-on signal, and enables the control part 20 to output the first control signal, and the light source 70 is controlled by the control part 20 to enter the momentary activation mode.

When the conductive switch column 31 moves by the second stroke, the elastic piece 23 has a first state, a second state and a third state, and in the first state, the normally open contact 233 contacts with the conductive switch column 31, the normally closed contact 232 contacts with the control circuit, and the control circuit receives a switching-on signal.

The conductive switch column 31 continues moving, and when the elastic piece 23 is in the second state, the normally open contact is driven by the conductive switch column 31 to get close to the control circuit and does not contact with the control circuit, the normally closed contact 232 is driven to be separated from the control circuit, and then the control circuit is not switched on, and receives a switching-off signal.

The conductive switch column 31 continues moving, and when the elastic piece 23 is in the third state, the normally open contact 233 contacts with the control circuit, the normally closed contact 232 is separated from the control circuit, the control circuit is switched on again, and the control circuit determines that the flashlight is required to enter the strobe mode when receiving a signal consistent with the preset switching on and switching off process within a preset time, and further sends the second control signal to make the light source 70 enter the strobe mode.

Referring to FIGS. 7 to 10, in the third embodiment of the invention, the electrical conductor comprises current pins 222, and its structure and working process are the same as those in the first embodiment.

There are multiple current pins 222, so that good and reliable contact with the conductive switch column 31 may be formed, and working reliability may be ensured. The electrical conductor may also comprise conductive sheets.

According to the invention, the single-chip microcomputer receives the signals to implement control over tactical momentary activation or tactical one-key strobe of the flashlight. When the conductive switch column 32 is slightly pressed down, the control circuit is switched on, the control circuit sends a signal, and the flashlight implements the momentary activation mode; and when the conductive switch column 32 is released, the conductive switch column 31 returns to the initial position under the action of the spring, the control circuit is switched off, a signal connection is cut off, and the light source is switched off.

When the conductive switch column 31 is rapidly pressed down, the control circuit implements a process of switching on (sending a signal) to switching off (cutting off the signal connection) to switching on (sending a signal), and when the single-chip microcomputer receives the signal, the light source 70 may be switched to the strobe mode, thereby realizing a one-key strobe function.

A momentary activation function is realized by slight pressing, and the one-key strobe function is realized by rapid pressing.

Referring to FIG. 11, when the conductive switch column 31 is pressed down, the first signal 91 is connected for switching on (the signal is sent), and the single-chip microcomputer receives the signal to implement momentary activation. When the conductive switch column 31 is continuously pressed down, both the first signal 91 and the second signal 92 are not connected to the circuit board 21, and the signal connection is cut off (switching off), and when the conductive switch column 31 is continuously pressed down, the second signal 92 is connected (the signal is sent), and the strobe function is realized after the single-chip microcomputer receives the signals of switching on-switching off-switching on.

From the above description, it can be seen that the embodiments of the invention achieve technical effects as follows: a mechanical switch is adopted, the switch is pressed down to generate mechanical action, and when the switch is slightly pressed down to send the first signal, the single-chip microcomputer receives the signal, the flashlight realizes the momentary activation function, and the flashlight is switched off under the action of the spring after the switch is released; and the switch is rapidly pressed down to send three electrical signals, and when the single-chip microcomputer receives the signals, the flashlight enters the strobe mode immediately. The switch is pressed down with one key to implement switching on to switching off to switching on of the signals or the circuit to implement one-key strobe in a mechanical manner.

The above is only the preferred embodiment of the invention and not intended to limit the invention, and for those skilled in the art, the invention may have various modifications and variations. Any modifications, equivalent replacements, improvements and the like made within a spirit and principle of the invention shall fall within the scope of protection of the invention.

The invention claimed is:

1. A switch structure, comprising:

a switch housing (10);

a control part (20), the control part (20) being provided in the switch housing (10); and a moving part (30), the moving part (30) being provided movably in the switch housing (10), the moving part (30) having a first stroke where the control part (20) is enabled to output a first control signal and a second stroke where the control part (20) is enabled to output a second control signal and the second stroke being consisted of the first stroke and a subsequent stroke after the first stroke;

wherein the control part (20) comprises a circuit board (21) and an electrical conductor which is provided on the circuit board (21) and connected with a control circuit on the circuit board (21), and the moving part (30) comprises:

a conductive switch column (31), the conductive switch column (31) being provided movably in the switch housing (10) and a first end of the conductive switch column (31) having a conductive head (32); and an insulating ring (33), the insulating ring (33) being fixedly provided on the conductive switch column (31) and located behind the conductive head (32), the conductive head (32) contacting with the electrical conductor and enabling the control circuit to output the first control signal when the moving part (30) moves by the first stroke, and the conductive head (32), the insulating ring (33) and the conductive switch column (31) sequentially contacting with the electrical conductor and enabling the control circuit to output the second control signal when the moving part (30) moves by the second stroke.

2. The switch structure according to claim 1, wherein the control part (20) comprises a control circuit, and when the moving part (30) moves by the first stroke, the control circuit of the control part (20) is switched on through the moving part (30), and outputs the first control signal; and when the moving part (30) moves to the second stroke within a preset time, the control circuit of the control part (20) undergoes a preset switching on and switching off process through the moving part (30), and outputs the second control signal.

3. The switch structure according to claim 2, wherein the preset switching on and switching off process is a process of switching on to switching off to switching on.

4. The switch structure according to claim 1, wherein a mounting hole (311) is provided in the first end of the conductive switch column (31), the conductive head (32) is a conductive screw, the conductive screw is mounted in the mounting hole (311), and the insulating ring (33) is provided on the conductive screw in a sleeving manner, and is located between a cap of the conductive screw and the conductive switch column (31).

5. The switch structure according to claim 1, wherein the circuit board (21) is provided with a through hole (211) through which the moving part (30) passes, and a part of the electrical conductor is raised from a peripheral wall of the through hole (211).

6. The switch structure according to claim 1, wherein the electrical conductor comprises conductive spring wires (221) or current pins (222) or conductive sheets.

7. The switch structure according to claim 1, wherein the control part (20) comprises a circuit board (21) and an elastic piece (23) which is provided on the circuit board (21) and connected with a control circuit of the circuit board (21), the elastic piece (23) is provided with a fixed end (231) connected with the control circuit, a normally closed contact (232) connected with the control circuit and a normally open contact (233) separated from the control circuit in a free state, the normally closed contact (232) and the normally open contact (233) are located on two sides of the circuit board (21) respectively, and are both connected with the fixed end (231), and the moving part (30) comprises:

a conductive switch column (31), the conductive switch column (31) being provided movably in the switch housing (10), the conductive switch column (31) contacting with the normally open contact (233) and enabling the control part (20) to output the first control signal when the conductive switch column (31) moves by the first stroke;

when the conductive switch column (31) moves by the second stroke, the elastic piece (23) has a first state, a second state and a third state; in the first state, the normally open contact (233) contacts with the conductive switch column (31) and the normally closed contact (232) contacts with the control circuit; in the second state, the normally open contact (233) is driven by the conductive switch column (31) to get close to the control circuit and does not contact with the control circuit, and the normally closed contact (232) is driven to be separated from the control circuit; and in the third state, the normally open contact (233) contacts with the control circuit and the normally closed contact (232) is separated from the control circuit.

8. The switch structure according to claim 1, further comprising an elastic returning part (40), wherein the elastic returning part (40) is provided between the moving part (30) and the switch housing (10), and drives the moving part (30) to return to an initial position.

9. The switch structure according to claim 4, wherein the electrical conductor comprises conductive spring wires (221) or current pins (222) or conductive sheets.

10. The switch structure according to claim 5, wherein the electrical conductor comprises conductive spring wires (221) or current pins (222) or conductive sheets.

11. A flashlight, comprising a light source (70) and a switch structure, wherein the switch structure is the switch structure according to claim 1, the light source (70) at least has a first state of continuous irradiation and a second state of switching on and switching off according to a preset frequency, the switch structure is electrically connected with the light source (70), the light source (70) is in the first state when the switch structure outputs a first control signal, and the light source (70) is in the second state when the switch structure outputs a second control signal.

12. A flashlight, comprising a light source (70) and a switch structure, wherein the switch structure is the switch structure according to claim 2, the light source (70) at least has a first state of continuous irradiation and a second state of switching on and switching off according to a preset frequency, the switch structure is electrically connected with the light source (70), the light source (70) is in the first state when the switch structure outputs a first control signal, and the light source (70) is in the second state when the switch structure outputs a second control signal.

13. A flashlight, comprising a light source (70) and a switch structure, wherein the switch structure is the switch structure according to claim 3, the light source (70) at least has a first state of continuous irradiation and a second state of switching on and switching off according to a preset frequency, the switch structure is electrically connected with the light source (70), the light source (70) is in the first state when the switch structure outputs a first control signal, and the light source (70) is in the second state when the switch structure outputs a second control signal.

14. A flashlight, comprising a light source (70) and a switch structure, wherein the switch structure is the switch structure according to claim 4, the light source (70) at least has a first state of continuous irradiation and a second state of switching on and switching off according to a preset frequency, the switch structure is electrically connected with the light source (70), the light source (70) is in the first state when the switch structure outputs a first control signal, and the light source (70) is in the second state when the switch structure outputs a second control signal.

15. A flashlight, comprising a light source (70) and a switch structure, wherein the switch structure is the switch structure according to claim 5, the light source (70) at least has a first state of continuous irradiation and a second state of switching on and switching off according to a preset frequency, the switch structure is electrically connected with the light source (70), the light source (70) is in the first state when the switch structure outputs a first control signal, and the light source (70) is in the second state when the switch structure outputs a second control signal.

16. A flashlight, comprising a light source (70) and a switch structure, wherein the switch structure is the switch structure according to claim 6, the light source (70) at least has a first state of continuous irradiation and a second state of switching on and switching off according to a preset frequency, the switch structure is electrically connected with the light source (70), the light source (70) is in the first state when the switch structure outputs a first control signal, and the light source (70) is in the second state when the switch structure outputs a second control signal.

17. A flashlight, comprising a light source (70) and a switch structure, wherein the switch structure is the switch structure according to claim 7, the light source (70) at least has a first state of continuous irradiation and a second state of switching on and switching off according to a preset frequency, the switch structure is electrically connected with the light source (70), the light source (70) is in the first state when the switch structure outputs a first control signal, and the light source (70) is in the second state when the switch structure outputs a second control signal.

18. A flashlight, comprising a light source (70) and a switch structure, wherein the switch structure is the switch structure according to claim 8, the light source (70) at least has a first state of continuous irradiation and a second state of switching on and switching off according to a preset frequency, the switch structure is electrically connected with the light source (70), the light source (70) is in the first state when the switch structure outputs a first control signal, and the light source (70) is in the second state when the switch structure outputs a second control signal.

* * * * *